US005228316A

United States Patent [19]

Meyrowitz

[11] Patent Number: 5,228,316

[45] Date of Patent: Jul. 20, 1993

[54] RING WITH REPLACEABLE MEMBERS

[76] Inventor: Scott B. Meyrowitz, P.O. Box 820383, Dallas, Tex. 75382-0383

[21] Appl. No.: 896,141

[22] Filed: Jun. 9, 1992

[51] Int. Cl.[5] ..... A44C 9/00

[52] U.S. Cl. ..... 63/154

[58] Field of Search ..... 63/15-15.8

[56] References Cited

U.S. PATENT DOCUMENTS

| | | | |
|---|---|---|---|
| 1,333,284 | 3/1920 | Schreiber | 63/15 |
| 1,586,606 | 6/1926 | Cain | 63/15.4 |
| 1,822,392 | 9/1931 | Esterman | 63/15.4 |
| 4,226,094 | 10/1980 | Wolpoff | 63/15.4 |
| 4,493,196 | 6/1985 | Bogner | 63/15 |

FOREIGN PATENT DOCUMENTS

| | | | |
|---|---|---|---|
| 25697 | 3/1883 | Fed. Rep. of Germany | 63/15.1 |
| 1912690 | 10/1970 | Fed. Rep. of Germany | 63/15.4 |
| 518718 | 5/1921 | France | 63/15.4 |
| 679812 | 4/1930 | France | 63/15 |
| 20155 | of 1895 | United Kingdom | 63/15.1 |

*Primary Examiner*—Peter M. Cuomo
*Assistant Examiner*—Flemming Saether
*Attorney, Agent, or Firm*—Glaser, Griggs & Schwartz

[57] ABSTRACT

A ring of the type adapted to worn on a person's finger is comprised of three distinct ring members. Two of the ring members are engageable for capturing the third ring member and are disengageable to allow the removal and replacement of one or more of the ring members. In one embodiment, a first ring member has substantially cylindrical first and second portions, the second portion being enlarged radially with respect to the first portion to define a first shoulder between the first and second portions. A second ring member has substantially cylindrical third and fourth portions, the fourth portion being enlarged radially with respect to the third portion to define a second shoulder between the second and third portions. The first portion is adapted for mating engagement with the third portion, whereby the first and second ring members are joined together. The third ring member is positionable in concentric relationship with the joined first and third portions. The first and second shoulders are adapted to engage opposed first and second faces of the third ring member, to capture the third ring member between the first and second ring members and in fixed concentric relationship with the joined first and third portions. The first and third portions are disengageable, to accommodate removal of the third ring member. The first, second and third ring members are selectively replaceable. Ring members of various types are selectively combinable to yield multiple ring designs and configurations.

8 Claims, 1 Drawing Sheet

RING WITH REPLACEABLE MEMBERS

FIELD OF INVENTION

This invention relates generally to rings adapted to be worn on a person's finger, and in particular to a ring comprising detachably coupled members to permit replacement of the members.

BACKGROUND OF THE INVENTION

Decorative rings are commonly worn by both men and women. Various styles and designs of decorative rings are available to suit individual tastes. Examples of decorative rings include the conventional wedding band made of gold or other precious metal and the engagement ring, which typically features a precious stone, such as a diamond, mounted on the band by means of prongs or the like. Rings featuring jeweled bands on which a plurality of precious stones are arranged circumferentially around the band are also popular.

DESCRIPTION OF THE PRIOR ART

It is known in the art to change the appearance and/or design of a ring by recasting the ring band or replacing the precious stones mounted on the band. Alternatively, one can purchase a variety of rings to be worn on different occasions.

DISCLOSURE OF THE INVENTION

In accordance with the present invention, a ring of the type adapted to be worn on a person's finger is comprised of a first, second and third ring members. The first and second ring members are engageable for capturing the third ring member between the first and second ring members and are disengageable to allow removal of the third ring member, whereby the third ring member is replaceable.

In accordance with one aspect of the invention, the first ring member has substantially cylindrical first and second portions, the second portion being enlarged radially with respect to the first portion to define a first shoulder between the first and second portions. The second ring member has substantially cylindrical third and fourth portions, the fourth portion being enlarged radially with respect to the third portion to define a second shoulder between the third and fourth portions. The first and third portions are adapted for mating engagement, whereby the first and second ring members are joined. The third ring member is an annular member having opposed first and second faces. The third ring member is positionable in concentric relationship with the first and third portions when the first and third portions are joined. The first and second shoulders are adapted to engage the respective first and second faces to capture the third ring member between the first and second shoulders in fixed concentric relationship with the joined first and third portions.

In one embodiment, the third ring member is a decorative band. In another embodiment, the third ring member is a jeweled band. In the preferred embodiment, the first portion has male screw threads on an outer annular surface thereof and the third portion has female screw threads on an inner annular surface thereof. The first portion is retained in mating engagement with the third portion by the engagement of the male screw threads with the female screw threads.

In accordance with the present invention, the third ring member, which is preferably a decorative band or a jeweled band, is replaceable by decoupling the first and second ring members to accommodate removal of the third ring member. The first and second ring members are also replaceable, such that first, second and third ring members of various types are selectively combinable to yield multiple ring designs and configurations.

DETAILED DESCRIPTION OF THE PREFERRED EMBODIMENT

Figure 1:
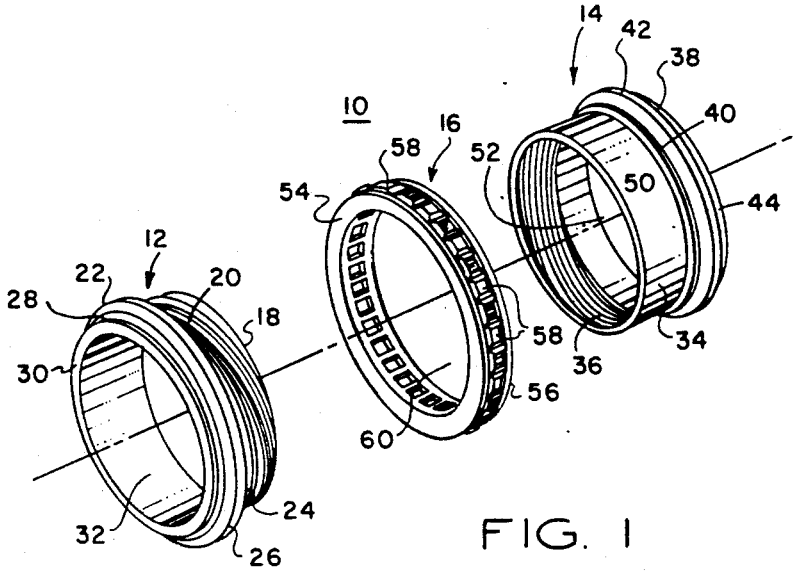
FIG 1 is an exploded perspective view of a ring with replaceable members, according to the present invention.

In the description which follows, like parts are marked throughout the specification and drawings with the same respective reference numerals. The drawings are not necessarily to scale and in some instances proportions may have been exaggerated in order to more clearly depict certain features of the invention.

Figure 2:
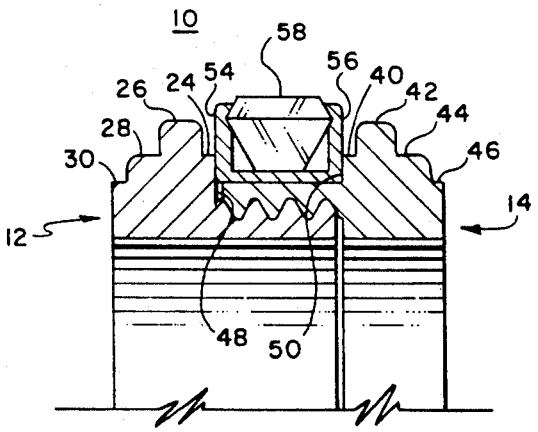
FIG. 2 is a sectional view of the assembled ring of FIG. 1.

Referring to FIGS. 1 and 2, a ring 10 is comprised of three distinct ring members 12, 14 and 16, respectively. Ring member 12 has a substantially cylindrical first portion 18 with male screw threads 20 on an outer annular surface thereof and a substantially cylindrical second portion 22, which is enlarged radially with respect to first portion 18.

Second portion 22 is "step-cut" to define a plurality of discrete annular sections 24, 26, 28 and 30. Sections 24 and 28 have substantially the same diameter. Section 26 has a larger diameter than that of sections 24 and 28. Section 30 has a smaller diameter than that of sections 24 and 28. First portion 18 is integrally formed with second portion 22 about a central bore 32, which is sized to accommodate a person's finger.

Ring member 14 has a substantially cylindrical third portion 34 with female screw threads 36 on an inner annular surface of third portion 34 and a substantially cylindrical fourth portion 38, which is enlarged radially with respect to third portion 34. Fourth portion 38 is also "step-cut" to define a plurality of discrete annular sections 40, 42, 44 and 46. Sections 40 and 44 have substantially the same diameter. Section 42 has a larger diameter than that of sections 40 and 44. Section 46 has a smaller diameter than that of sections 40 and 44. Third portion 34 is integrally formed with fourth portion 38 in concentric relationship about a central bore 52, which is sized to receive first portion 18 in mating relationship. As can be best seen in FIG. 1, sections 24 and 40 are enlarged with respect to first and third portions 18 and 34, respectively, to define respective first and second shoulders 48 and 50, respectively. Female screw threads 36 are complementary with male screw threads 20, such that first and third portions 18 and 34 are secured in mating relationship by the engagement of male and female screw threads 20 and 36.

Ring member 16 is preferably an annular member having opposed first and second faces 54 and 56, respectively. In the embodiments shown in FIGS. 1 and 2, ring member 16 includes a plurality of precious stones 58, arranged circumferentially about ring member 16. Ring member 16 has a central bore 60, which is sized to receive third portion 34 in mating relationship, as will be described in greater detail hereinafter.

Ring 10 is assembled as shown in FIG. 2. Third portion 34 is inserted into bore 60, such that ring member 16 is in concentric relationship with third portion 34. First portion 18 is then inserted into bore 52 and first ring member 12 is turned with respect to second ring member 14 to engage male screw threads 20 with female screw threads 36 and secure first portion 18 in mating relationship with third portion 34. As such, first and third portions 18 and 34 function as coupling members, to join ring members 12 and 14. When ring members 12 and 14 are joined as shown in FIG. 2, first and second shoulders 48 and 50 engage respective first and second faces 54 and 56 in pressure engagement such that there remains a space between said third portion and said first shoulder, to capture ring member 16 between second and fourth portions 22 and 38 and in fixed concentric relationship with the joined first and third portions 18 and 34. The assembled ring 10 is adapted to fit on a person's finger.

In accordance with one feature of the invention, any one or more of ring members 12, 14 and 16 are removable by decoupling ring members 12 and 14. Decoupling of ring members 12 and 14 is preferably accomplished by turning ring member 12 with respect to ring member 14 so as to disengage male and female screw threads 20 and 36. After ring members 12 and 14 are decoupled, any one or more of ring members 12, 14 and 16 can be removed and replaced.

Figure 3:
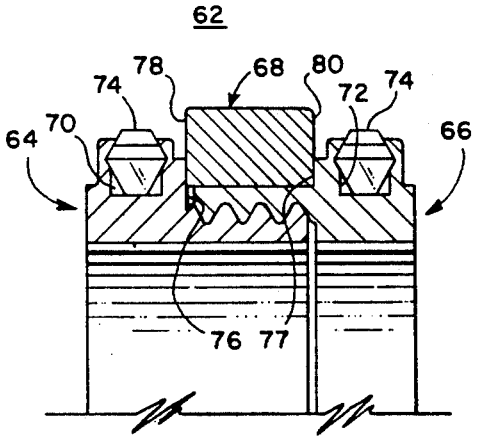
FIG. 3 is a sectional view of an alternate embodiment of a ring with replaceable members, according to the present invention.

Referring now to FIG. 3, a first alternate embodiment of the invention is depicted. A ring 62 is comprised of ring members 64, 66 and 68. Ring members 64 and 66 have respective circumferential channels 70 and 72, which are configured to receive a plurality of precious stones 74. Ring member 68 is preferably a decorative band made of a precious metal, such as gold. Ring members 64 and 66 perform the same function as ring members 12 and 14 with respect to capturing an insert member (in this embodiment, ring member 68). Ring members 64 and 66 are coupled together by the engagement of male screw threads on an outer annular surface of ring member 64 with complementary female screw threads on an inner annular surface of ring member 66. First and second shoulders 76 and 77 engage respective opposed first and second faces 78 and 80 of ring member 68 in pressure engagement such that there remains a space between said third portion and said first shoulder, to capture ring member 68 between ring members 64 and 66 and in fixed concentric relation about the joined threaded portions of ring members 64 and 66.

Figure 4:
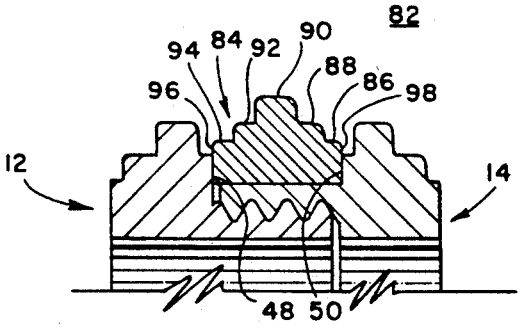
FIG. 4 is a sectional view of a second alternate embodiment of a ring with replaceable members, according to the present invention.

Referring now to FIG. 4, a second alternate embodiment of the invention is depicted. A ring 82 is comprised of ring members 12, 14 and 84. Ring 82 differs from ring 10, previously described with respect to FIGS. 1 and 2, in that ring member 16 has been replaced with ring member 84. Ring member 84 is "stepcut" to define a plurality of discrete cylindrical sections 86, 88 90, 92 and 94. When ring members 12 and 14 are joined together in mating relationship, as shown in FIG. 4, first and second shoulders 48 and 50 engage respective opposed faces 96 and 98 of ring member 84 in pressure engagement such that there remains a space between said third portion and said first shoulder, to capture ring member 84 between ring members 12 and 14 and in fixed concentric relationship with the joined threaded portions of ring members 12 and 14.

Figure 5:
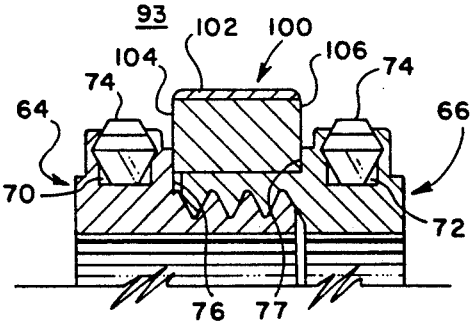
FIG. 5 is a third alternate embodiment of a ring with replaceable members, according to the present invention.

Referring now to FIG. 5, a third alternate embodiment of the invention is depicted. A ring 93 is comprised of ring members 64, 66 and 100. Ring 93 differs from ring 62, previously described with respect to FIG. 3, in that ring member 68 has been replaced by ring member 100. Ring member 98 is preferably a decorative band with an enamel coating 102. Ring member 100 is positioned in concentric relationship with the joined threaded portions of ring members 64 and 66. When ring members 64 and 66 are joined together in mating relationship, as shown in FIG. 5, first and second shoulders 76 and 77 engage respective opposed faces 104 and 106 of ring member 100 in pressure engagement such that there remains a space between said third portion and said first shoulder, to capture ring member 100 between ring members 64 and 66 and in fixed concentric relationship with the joined threaded portions of ring members 64 and 66.

In accordance with the present invention, a ring adapted to be worn on a person's finger is comprised of a plurality of ring members, which are detachably coupled to allow for the removal and replacement of one or more of the ring members. Ring members of various types are selectively combinable to yield multiple ring designs and configurations. For example, the outer ring members may be configured to include a ridged exterior, a diamond exterior, a "fluted" configuration or a "gold and square" configuration. The insert member may be configured as a gold band, a jeweled band or an enameled band. By selectively replacing individual ring members, instead of the entire ring, a variety of decorative styles and configurations can be achieved relatively economically.

The preferred embodiment of the invention has now been described in detail. Since it is obvious that many changes in and additions to the above-described preferred embodiment may be made without departing from the nature, spirit and scope of the invention, the invention is not to be limited to the disclosed details, except as set forth in the appended claims.

What is claimed is:

1. A ring, comprising:

a first ring member having substantially cylindrical first and second portions, said first portion having male screw threads on an outer surface thereof, said second portion being enlarged radially with respect to said first portion to define a first shoulder between said first and second portions;

a second ring member having substantially cylindrical third and fourth portions, said third portion having female screw threads on an inner surface thereof, said female screw threads being complementary with said male screw threads, said fourth portion being enlarged radially with respect to said third portion to define a second shoulder between said third and fourth portions, said first portion being in mating engagement with said third portion and being retained in mating engagement with said third portion by the engagement of said male screw threads with said female screw threads, whereby said first and second ring members are joined; and a third ring member having opposed first and second faces, said third ring member being in concentric relationship with said joined first and third portions, said first and second shoulders being in pressure engagement with the respective first and second faces to capture said third ring member between said first and second shoulders and in concentric relationship with said joined first and third portions, the spacing between said first and second shoulders being adjustable to accommodate the spacing between said first and second faces by adjusting the depth of penetration of said first portion into said third portion such that there remains a space between said third portion and said first shoulder, said first and third portions being disengageable to allow removal of said third ring member.

2. The ring of claim 1 wherein said third ring member is a decorative band.

3. The ring of claim 1 wherein said third ring member is a jeweled band.

4. The ring of claim 1 wherein said first, second and third ring members are selectively replaceable.

5. A ring assembly, comprising:

a first ring member having substantially cylindrical first and second portions, said first portion having male screw threads on an outer surface thereof, said second portion being enlarged radially with respect to said first portion to define a first shoulder between said first and second portions;

a second ring member having substantially cylindrical third and fourth portions, said third portion having female screw threads on an inner surface thereof, said female screw threads being complementary with said male screw threads, said fourth portion being enlarged radially with respect to said third portion to define a second shoulder between said third and fourth portions, said first portion being matingly engageable with said third portion and being retainable in mating engagement with said third portion by the engagement of said male screw threads with said female screw threads, whereby said first and second ring members are joinable; and a third ring member having opposed first and second faces, said third ring member being positionable in concentric relationship with said first and third portions when said first and third portions are in mating engagement, said first and second shoulders being adapted to engage the respective first and second faces in pressure engagement to capture said third ring member between said first and second shoulders and in concentric relationship with said first and third portions when said first and third portions are in mating engagement, the spacing between said first and second shoulders being adjustable to accommodate the spacing between said first and second faces by adjusting the depth of penetration of said first portion into said third portion such that there remains a space between said third portion and said first shoulder, said first and third portions being disengageable to allow removal of said third ring member.

6. The ring assembly of claim 5 wherein said third ring member is a decorative band.

7. The ring assembly of claim 5 wherein said third ring member is a jeweled band.

8. The ring of claim 5 wherein said first, second and third ring members are selectively replaceable.

* * * * *